US008247023B2

(12) United States Patent
Liu et al.

(10) Patent No.: US 8,247,023 B2
(45) Date of Patent: Aug. 21, 2012

(54) METHOD FOR MAKING THERMIONIC ELECTRON SOURCE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 962 days.

(21) Appl. No.: 12/288,861

(22) Filed: Oct. 23, 2008

(65) Prior Publication Data

US 2009/0170394 A1 Jul. 2, 2009

(30) Foreign Application Priority Data

Dec. 29, 2007 (CN) ..... 2007 1 0125673

(51) Int. Cl.
*B05D 5/12* (2006.01)

(52) U.S. Cl. ..... 427/77; 427/64; 427/74

(58) Field of Classification Search ..... 427/64.74, 427/77, 64, 74

See application file for complete search history.

(56) References Cited

U.S. PATENT DOCUMENTS

| | | | | |
|---|---|---|---|---|
| 5,905,335 | A | 5/1999 | Fushimi et al. | |
| 6,843,696 | B2 | 1/2005 | Kitamura et al. | |
| 7,034,449 | B2 | 4/2006 | Suzuki et al. | |
| 7,057,336 | B2 | 6/2006 | Kishi et al. | |
| 2003/0160570 | A1 | 8/2003 | Sasaki et al. | |
| 2006/0057279 | A1 * | 3/2006 | Terada et al. | 427/77 |
| 2006/0124958 | A1 * | 6/2006 | Cox et al. | 257/109 |
| 2006/0208620 | A1 | 9/2006 | Muneyoshi et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |

FOREIGN PATENT DOCUMENTS

| | | | |
|---|---|---|---|
| CN | 1440044 | A | 9/2003 |
| CN | 1773664 | A | 5/2006 |
| CN | 101471211 | A | 7/2009 |
| EP | 125859 | * | 5/1984 |
| JP | 2005-100757 | | 4/2005 |
| JP | 2009-146896 | | 7/2009 |
| JP | 2009-164119 | | 7/2009 |
| TW | 588392 | | 5/2004 |
| TW | 200609974 | | 3/2006 |
| TW | 200621890 | | 7/2006 |
| TW | I262171 | | 9/2006 |
| TW | I267106 | | 11/2006 |
| TW | 200720846 | | 6/2007 |
| TW | 200739649 | | 10/2007 |

OTHER PUBLICATIONS

Cox et al., Thermionic emission from defective carbon nanotubes, Applied Physics Letters, Sep. 13, 2004, 2065-2067, vol. 85, No. 11.

* cited by examiner

*Primary Examiner* — Brian K Talbot
(74) *Attorney, Agent, or Firm* — Altis Law Group, Inc.

(57) ABSTRACT

A method for making a thermionic electron source includes the following steps: (a) supplying a substrate; (b) forming a first electrode and a second electrode thereon; and (c) spanning a carbon nanotube film structure on a surface of the first electrode and the second electrode with a space defined between the thermionic emitter and the substrate.

17 Claims, 2 Drawing Sheets

METHOD FOR MAKING THERMIONIC ELECTRON SOURCE

RELATED APPLICATIONS

This application is related to commonly-assigned applications entitled, "THERMIONIC ELECTRON SOURCE", Ser. No. 12/288865, filed on Oct. 23, 2008; "THERMIONIC EMISSION DEVICE", Ser. No. 12/288996, filed on Oct. 23,2008; "THERMIONIC EMISSION DEVICE", Ser. No. 12/288863, filed on Oct. 23,2008; "THERMIONIC ELECTRON EMISSION DEVICE AND METHOD FOR MAKING THE SAME", Ser. No. 12/288864, filed on Oct. 23,2008; and "THERMIONIC ELECTRON SOURCE", Ser. No. 12/288862, filed on Oct. 23, 2008.

BACKGROUND

1. Field of the Invention

The present invention relates to a method for making a thermionic electron source adopting carbon nanotubes.

2. Discussion of Related Art

Carbon nanotubes (CNT) are a carbonaceous material and have received much interest since the early 1990s. Carbon nanotubes have interesting and potentially useful electrical and mechanical properties. Due to these and other properties, CNTs have become a significant contributor to the research and development of electron emitting devices, sensors, and transistors, among other devices.

Generally, an electron-emitting device has an electron source using a thermal or cold electron source. The thermal electron source is used by heating an emitter to increase the kinetic energy of the electrons in the emitter. When the kinetic energy of the electrons therein is large enough, the electrons will emit or escape from the emitters. These electrons emitted from the emitters are thermions. The emitters emitting the thermions are named thermionic emitters.

Conventionally, the thermionic electron source includes a thermionic emitter and two electrodes. The two electrodes are located on a substrate. The thermionic emitter is located between two electrodes and electrically connected thereto. The thermionic emitter is generally made of a metal, a boride or an alkaline earth metal carbonate. The thermionic emitter can be divided into two types, a direct-heating type and an indirect-heating type. The thermionic emitter of the direct-heating type uses a metal ribbon or a metal thread as the thermionic emitter. The metal ribbon or metal thread is fixed between the two electrodes by welding. During use, a voltage is applied between the two electrodes to heat the metal ribbon or metal thread. Kinetic energy of the electrons in the metal ribbon or metal thread is increased. When the kinetic energy of the electrons therein is large enough, thermions will emit or escape from the emitters. The thermionic emitter of the indirect-heating type uses a boride or an alkaline earth metal carbonate as a material of the thermionic emitter. The boride or alkaline earth metal carbonate is dispersed in a conductive slurry, and the conductive slurry is directly coated or sprayed on a heater. The heater can be secured between the two electrodes as a thermionic emitter. During use, a voltage is applied between the two electrodes to heat the thermionic emitter. Kinetic energy of the electrons in the thermionic emitter is increased. When the kinetic energy of the electrons therein is large enough, thermions will emit or escape from the emitters. However, the size of the thermionic emitter using the metal, boride or alkaline earth metal carbonate is large, thereby limiting its application in micro-devices. Furthermore, the coating formed by direct coating or spraying the metal, boride or alkaline earth metal carbonate has a high resistivity, and thus, the thermionic electron source using the same has a greater power consumption and is therefore not suitable for applications involving high current density and brightness.

What is needed, therefore, is a method for making a thermionic electron source having excellent thermal electron emitting properties and wearability, and can be used in flat panel displays with high current density and brightness, logic circuits, and other fields of thermal electron source.

SUMMARY

In one embodiment, a method for making a thermionic electron source includes the following steps: (a) supplying a substrate; (b) forming a first electrode and a second electrode thereon; and (c) spanning a carbon nanotube film structure on a surface of the first electrode and the second electrode with a space defined between the thermionic emitter and the substrate.

Other novel features and advantages of the present method for making a thermionic electron source will become more apparent from the following detailed description of exemplary embodiments when taken in conjunction with the accompanying drawings.

BRIEF DESCRIPTION OF THE DRAWINGS

Many aspects of the present method for making a thermionic electron source can be better understood with references to the following drawings. The components in the drawings are not necessarily drawn to scale, the emphasis instead being placed upon clearly illustrating the principles of the present method for making a thermionic electron source.

Figure 1:
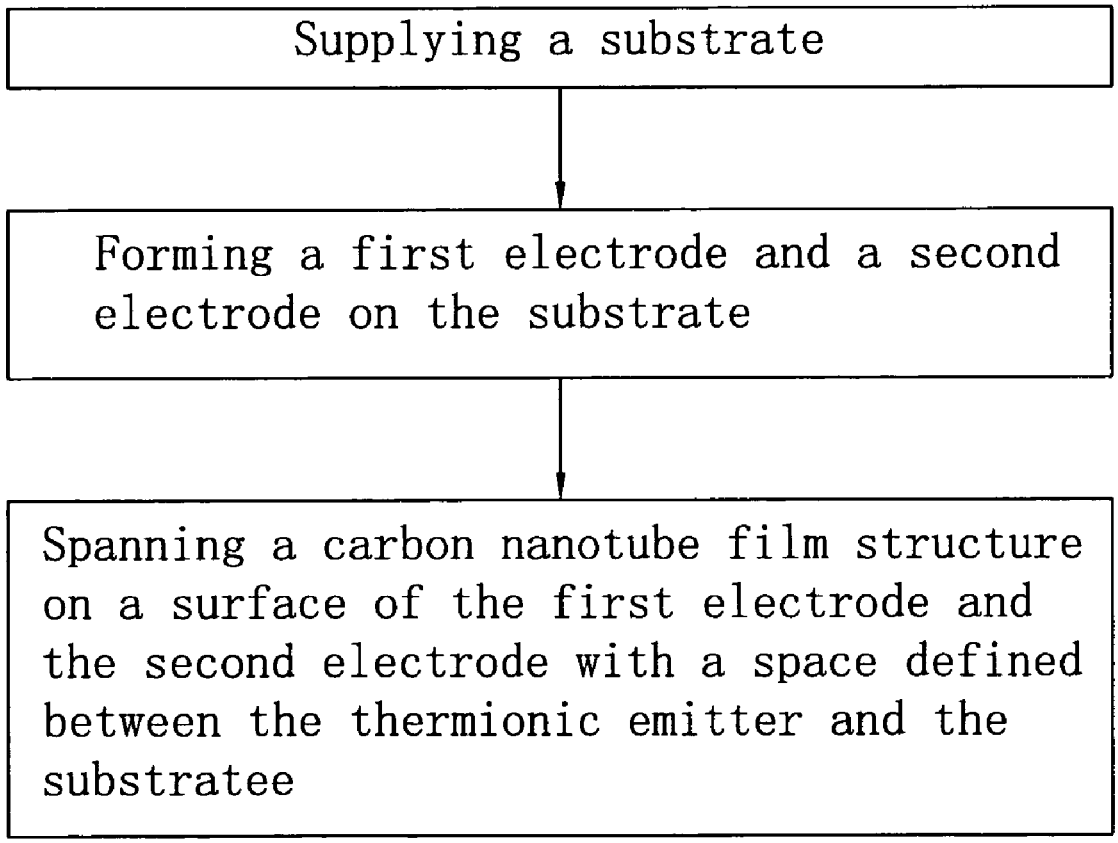
FIG. 1 is a flow chart of a method for making a thermionic electron source, in accordance with the present embodiment

Corresponding reference characters indicate corresponding parts throughout the views. The exemplifications set out herein illustrate at least one embodiment of the present method for making a thermionic electron source, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present method for making a thermionic electron source.

Referring to FIG. 1, a method for making a thermionic electron source includes the following steps: (a) supplying a substrate; (b) forming a first electrode and a second electrode on the substrate; and (c) spanning a carbon nanotube film structure on a surface of the first electrode and the second electrode with a space defined between the thermionic emitter and the substrate.

In step (a), the substrate can be made of ceramics, glass, resins, or quartz, among other insulative materials. A size and shape of the substrate can be set as desired. In the present embodiment, the substrate is a glass substrate.

In step (b), a thickness of the first electrode and the second electrode approximately ranges from 1 micrometer to 2 millimeters. A distance between the first electrode and the second electrode approximately ranges from 50 micrometers to 1 millimeter. The first electrode and the second electrode can be formed on the substrate by a method selected from a group consisting of a screen-printing method, an offset printing method, an electrostatic spraying method, an electrophoresis method, a lithography coating method, and a UV-curing method. The first electrode and the second electrode can be formed by coating conductive glue on a surface of the substrate to secure the first electrode and the second electrode thereon. In the present embodiment, the first electrode and the second electrode are formed by a screen-printing method.

Step (b), executed by the screen-printing method, further includes the following substeps: (b1) supplying a conductive slurry; (b2) coating the conductive slurry on the surface of the substrate according to a predetermined pattern; and (b3) heat treating the substrate with the conductive slurry thereon, thereby forming the first electrode and the second electrode.

In step (b1), the conductive slurry includes conductive materials, adhesives, organic solvent and organic additive. The conductive material can be selected from a group consisting of gold, silver, copper and other conductive metal. The adhesive can be selected from a group consisting of inorganic binder, organic binder, and low melting point metals. The inorganic binder includes glass powder, silane and water glass. The organic binder includes fiber resins, acrylic resins, and ethylene resin. The adhesive can adhere conductive particles together, and adhere conductive slurry on the surface of the substrate. A weight ratio of the conductive slurry and the adhesive approximately ranges from 0.1:10 to 10:1.

The organic additive includes a tackifying agent, dispersants, plasticizers, or a surface-active agent. The plasticizers can be selected from a group consisting of grass diethyl, and butyl ether. The organic solvent can be selected from a group consisting of ethanol, glycol, hydrocarbons, water, any other traditional solvents and the mixture thereof. Additionally, the organic solvent and organic additive can adjust the properties of the conductive slurry, such as viscosity, fluidity, dry speed, and other physical properties, and thus, it is conducive to coat the conductive slurry on the substrate. An amount of the organic solvents and additives can be adjusted according to the printing process. The conductive slurry can be placed into a stirring device to uniformly mix the ingredients thereof.

In the present embodiment, the conductive slurry includes a weight ratio of 75% silver, 21% adhesives, 3% low melting glass powder, and 2% ethanol. The adhesives are a solution of ethyl cellulose dispersed in terpineol. The conductive glurry is placed in a three-roll roller mill to uniformly distribute the ingredients thereof.

Step (b3) can be executed in an atmosphere or an environment with oxidized gas therein. A temperature of the heat treatment can be set according to organic ingredients of the conductive slurry. Generally, the temperature of the heat treatment is lower than 600° C. The heat treatment is used to form a good mechanical and electrical contact between the first electrode, the second electrode, and the substrate.

In the present embodiment, step (b3) can be executed by the following steps. Firstly, the conductive slurry is heated from 20° C. for 10 minutes, the temperature of the conductive slurry reaching up to 120° C. Then the temperature is held for 10 minutes to remove the terpineol and ethanol in the conductive slurry. Secondly, the conductive slurry is heated for 30 minutes, the temperature of the conductive slurry reaching up to 350° C. Then the temperature is held for 30 minutes to remove the ethyl cellulose. Thirdly, the conductive slurry is heated for 30 minutes, the temperature of the conductive slurry reaching up to 460-580° C. Then the temperature is held for 30 minutes to closely combine the conductive slurry and the substrate. Finally, the conductive slurry is naturally cooled, thereby a first electrode and a second electrode are separately formed on the substrate.

Step (c) can be executed by the following steps: (c1) forming at least one carbon nanotube film; and (c2) placing the at least one carbon nanotube film on the first electrode and the second electrode to form a carbon nanotube film structure.

In step (c1), the method for making the carbon nanotube film includes the following steps: (c11) providing an array of carbon nanotubes, specifically, providing a super-aligned array of carbon nanotubes; (c12) pulling out a carbon nanotube film from the array of carbon nanotubes, by using a tool (e.g., adhesive tape, pliers, tweezers, or another tool allowing multiple carbon nanotubes to be gripped and pulled simultaneously).

In step (c11), a given super-aligned array of carbon nanotubes can be formed by the following substeps. Firstly, a substantially flat and smooth substrate is provided. Secondly, a catalyst layer is formed on the substrate. Thirdly, the substrate with the catalyst layer thereon is annealed in air at a temperature approximately ranging from 700° C. to 900° C. for about 30 to 90 minutes. Fourthly, the substrate with the catalyst layer thereon is heated to a temperature approximately ranging from 500° C. to 740° C. in a furnace with a protective gas therein. Fifthly, a carbon source gas is supplied to the furnace for about 5 to 30 minutes, and the super-aligned array of carbon nanotubes is grown on the substrate.

The substrate can be a P-type silicon wafer, an N-type silicon wafer, or a silicon wafer with a film of silicon dioxide thereon. Preferably, a 4-inch P-type silicon wafer is used as the substrate. The catalyst can be made of iron (Fe), cobalt (Co), nickel (Ni), or any alloy thereof. The protective gas can be made up of at least one of nitrogen ($N_2$), ammonia ($NH_3$), and a noble gas. The carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can be approximately 200 to 400 microns in height and include a plurality of carbon nanotubes parallel to each other and substantially perpendicular to the substrate. The carbon nanotubes in the array can be selected from a group consisting of single-walled carbon nanotubes, double-walled carbon nanotubes, or multi-walled carbon nanotubes. A diameter of the single-walled carbon nanotubes approximately ranges from 0.5 to 50 nanometers. A diameter of the double-walled carbon nanotubes approximately ranges from 1 to 10 nanometers. A diameter of the multi-walled carbon nanotubes approximately ranges from 1.5 to 10 nanometers.

The super-aligned array of carbon nanotubes formed under the above conditions is essentially free of impurities, such as carbonaceous or residual catalyst particles. The carbon nanotubes in the super-aligned array are closely packed together by the van der Waals attractive force.

Step (c12) can be executed by selecting a plurality of carbon nanotube segments having a predetermined width from the array of carbon nanotubes, and pulling the carbon nanotube segments at an even/uniform speed to achieve a uniform carbon nanotube film.

The carbon nanotube segments having a predetermined width can be selected by using an adhesive tape such as the tool to contact with the super-aligned array. The pulling direction is substantially perpendicular to the growing direction of the super-aligned array of carbon nanotubes.

More specifically, during the pulling process, as the initial carbon nanotube segments are drawn out, other carbon nanotube segments are also drawn out end-to-end due to the van der Waals attractive force between ends of adjacent segments. This process of drawing ensures a continuous, uniform carbon nanotube film having a predetermined width can be formed. The carbon nanotube film includes a plurality of carbon nanotube segments. The carbon nanotubes in the carbon nanotube film are all substantially parallel to the pulling/drawing direction of the carbon nanotube film, and the carbon nanotube film produced in such manner can be selectively formed having a predetermined width. The carbon nanotube film formed by the pulling/drawing method has superior uniformity of thickness and conductivity over a disordered carbon nanotube film. Furthermore, the pulling/drawing method is simple, fast, and suitable for industrial applications.

Step (c2) can be executed by several methods. A first method is executed by placing a carbon nanotube film on a surface of the first electrode and the second electrode along a direction extending from the first electrode to the second electrode. A second method is executed by covering at least two carbon nanotube films stacked with each other and situated such that a preferred orientation of the carbon nanotubes is set at an angle with respect to each other. The angle approximately ranges from 0° to 90°. A third method is executed by the following steps: (c21) supplying a supporting element; (c22) covering at least two carbon nanotube films stacked on each other and situated such that a preferred orientation of the carbon nanotubes being set at an angle with respect to each other to form a carbon nanotube film structure, the angle approximately ranging from 0° to 90°; (c23) cutting away excess portions of the carbon nanotube film structure; (c24) treating the carbon nanotube film structure via an organic solvent; (c25) removing the carbon nanotube film structure from the supporting element to form a free-standing carbon nanotube film structure; and (c26) placing the free-standing carbon nanotube film structure on the surface of the first electrode and the second electrode. Since the carbon nanotube film has a high surface-area-to-volume ratio, the carbon nanotube structure formed by at least one carbon nanotube film may easily adhere to other objects. Thus, the carbon nanotube film can directly be fixed on the first electrode, the second electrode, or the substrate because of the adhesion properties of the nanotubes. It can be understood that the carbon nanotube structure can also be secured on the first electrode and the second electrode via adhesive or conductive glue.

The carbon nanotube film structure secured on the first electrode and the second electrode can be treated with an organic solvent. The carbon nanotube film structure can be treated by dropping the organic solvent from a dropper to soak the entire surface of the carbon nanotube film structure or immerging the carbon nanotube film structure in a container with organic solvent filled therein. The organic solvent is volatilizable and can be selected from the group consisting of ethanol, methanol, acetone, dichloroethane, chloroform, and combinations thereof. In the present embodiment, the organic solvent is ethanol. After being soaked by the organic solvent, the carbon nanotube film structure can more firmly adhere to the surface of the first electrode or the second electrode due, in part at least, to the surface tension created by the organic solvent. The specific surface area of the film is decreased by the treatment. The high mechanical strength and toughness thereof is still maintained.

A low-work-function layer can be further formed on the surface of the carbon nanotube film structure by a sputtering or vacuum evaporation method. The low-work-function layer is made of any material capable of inducing the emissions of electrons from the thermionic electron source at a low temperature, such as thorium oxide or barium oxide. Electrons in the low-work-function layer have a lower work function than that in the thermionic emitter, and can escape from the low-work-function layer at a lower temperature. Thus, the low-work-function layer can be used to induce emissions of electrons from the thermionic electron source at a lower temperature.

At least one fixing element can be further formed on the surface of the first electrode and the second electrode by a screen printing method, offset printing method, electrostatic spraying method, electrophoresis method, lithography coating method or other methods such as UV-curing. Two ends of the carbon nanotube film structure are fixed between the first electrode, the second electrode, and the fixing elements.

Figure 2:
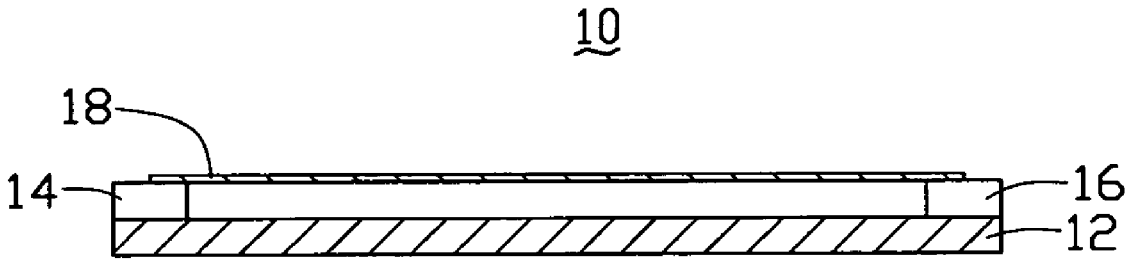
FIG. 2 is an exploded, isometric view of a thermionic electron source in accordance with the present embodiment.

Referring to FIG. 2, a thermionic electron source 10 acquired by the present method, in accordance with the present embodiment, includes a substrate 12, a first electrode 14, a second electrode 16, and a thermionic emitter 18. The first electrode 14 and second electrode 16 are separately located on a surface of the substrate 12. The thermionic emitter 18 is located between the first electrode 14 and second electrode 16 and electrically connected thereto. The thermionic emitter 18 is suspended above the substrate 12 by the first electrode 14 and second electrode 16. The thermionic emitter 18 has a film structure.

Compared to conventional technologies, the method for making the thermionic electron source provided by the present embodiments has the following advantages. Firstly, since the carbon nanotube film structure is formed by at least one carbon nanotube film pulled from a carbon nanotube array, the method is simple and low-cost. Secondly, the thermionic electron source adopting the carbon nanotube film structure prepared by the present embodiment can acquire a uniform and stable thermal electron emissions state. Thirdly, since the carbon nanotube film structure and the substrate are separately located, the substrate will not transfer the energy for heating the carbon nanotube film structure to the atmosphere in the process of heating, and as a result, the thermionic electron source will have an excellent thermionic emitting property. Finally, since the carbon nanotube film structure has a small width and a low resistance, the thermionic electron source adopting the carbon nanotube carbon nanotube film structure can emit electrons at a low thermal power, thus the thermionic electron source can be used for high current density and high brightness of the flat panel display and logic circuits, among other fields.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A method for making a thermionic electron source, the method comprising the following steps:

(a) supplying a substrate;

(b) forming a first electrode and a second electrode on the substrate;

(c1) forming at least one carbon nanotube film;

(c2) spanning the at least one carbon nanotube film on a surface of the first electrode and the second electrode with a space defined between the at least one carbon nanotube film and the substrate; and treating the at least one carbon nanotube film with an organic solvent.

2. The method as claimed in claim 1, wherein step (b) is executed by a method selected from the group consisting of a screen-printing method, an offset printing method, an electrostatic spraying method, an electrophoresis method, a lithography coating method, and a UV-curing method.

3. The method as claimed in claim 1, wherein step (b) comprises the following steps:

(b1) supplying a conductive slurry;

(b2) coating the conductive slurry on a surface of the substrate according to a predetermined pattern; and (b3) heat treating the substrate with the conductive slurry thereon, thereby acquiring the first electrode and the second electrode.

4. The method as claimed in claim 3, wherein the conductive slurry comprises conductive materials, adhesives, organic solvent and organic additive.

5. The method as claimed in claim 4, wherein the conductive material is selected from the group consisting of silver, gold, and copper; the adhesive can be selected from the group consisting of inorganic adhesive, organic adhesive, and low melting point metals; and a weight ratio of the conductive slurry and the adhesive approximately ranges from 0.1:10 to 10:1.

6. The method as claimed in claim 4, wherein the organic solvent is selected from the group consisting of ethanol, glycol, hydrocarbons, water, and the mixture thereof.

7. The method as claimed in claim 4, wherein the organic additive is selected from the group consisting of tackifying agent, dispersants, plasticizers, and surface-active agent.

8. The method as claimed in claim 4, wherein step (b3) is executed by heat treating the substrate with the conductive slurry thereon to remove organic ingredients therein, and cooling the conductive slurry, thereby forming the first electrode and the second electrode on the substrate.

9. The method as claimed in claim 8, wherein a temperature of the heat treatment is lower than or equal to 600° C.

10. The method as claimed in claim 1, wherein step (c1) comprises the following steps:

(c11) providing an array of carbon nanotubes; and (c12) pulling out a carbon nanotube film from the array of carbon nanotubes with a tool.

11. The method as claimed in claim 1, wherein step (c2) is executed by spanning the at least one carbon nanotube film on the surface of the first electrode and the second electrode along a direction extending from the first electrode to the second electrode.

12. The method as claimed in claim 1, wherein step (c2) is executed by spanning at least two carbon nanotube films stacked with each other and situated such that a preferred orientation of the carbon nanotubes is set at an angle with respect to each other, the angle approximately ranging from 0° to 90°.

13. The method as claimed in claim 1, wherein step (c2) is executed by the following steps:

(c21) supplying a supporting element;

(c22) stacking at least two carbon nanotube films and being situated such that a preferred orientation of the carbon nanotubes of one of the films is set at an angle with respect to each other to form a carbon nanotube film structure, the angle approximately ranging from 0° to 90°;

(c23) cutting away excess portion of the carbon nanotube film structure;

(c24) treating the carbon nanotube film structure via an organic solvent;

(c25) removing the carbon nanotube film structure from the supporting element to form a free-standing carbon nanotube film structure; and (c26) using the free-standing carbon nanotube film structure as the carbon nanotube film structure.

14. The method as claimed in claim 1, wherein the at least one carbon nanotube film is treated by either applying the organic solvent to the entire surface of the at least one carbon nanotube film or immerging the at least one carbon nanotube film in a container filled with the organic solvent.

15. The method as claimed in claim 14, wherein the organic solvent is volatilizable and can be selected from the group consisting of ethanol, methanol, acetone, dichloroethane, chloroform, and combinations thereof.

16. The method as claimed in claim 1, further comprising a step of coating a conductive glue on the surface of the first electrode and the second electrode.

17. The method as claimed in claim 1, further comprising a step of forming at least one fixing element on the surface of the first electrode and the second electrode by a screen printing method, offset printing method, electrostatic spraying method, electrophoresis method, lithography coating method or a UV-curing method to secure the at least one carbon nanotube film on the surface of the first electrode and the second electrode.

* * * * *